United States Patent [19]

Schlegel

[11] Patent Number: 4,590,342

[45] Date of Patent: May 20, 1986

[54] PANEL MOUNTED SWITCHING DEVICE

[75] Inventor: Eberhard Schlegel, Dürmentingen, Fed. Rep. of Germany

[73] Assignee: Firma Georg Schlegel, Dürmentingen, Fed. Rep. of Germany

[21] Appl. No.: 549,555

[22] Filed: Nov. 7, 1983

[30] Foreign Application Priority Data

Nov. 8, 1982 [DE] Fed. Rep. of Germany ..... 3241159
Sep. 29, 1983 [DE] Fed. Rep. of Germany ..... 3335275

[51] Int. Cl.[4] ..... H01H 13/52

[52] U.S. Cl. ..... 200/159 B; 200/159 R; 200/296; 200/314

[58] Field of Search ..... 200/159 R, 159 B, 5 A, 200/294, 303, 340, 314

[56] References Cited

U.S. PATENT DOCUMENTS

| | | | |
|---|---|---|---|
| 2,765,382 | 10/1956 | Kelto | 200/303 |
| 2,969,443 | 1/1961 | Barden et al. . | |
| 3,091,679 | 5/1963 | Norden . | |
| 3,749,872 | 7/1973 | Foster | 200/159 A |
| 3,770,925 | 11/1973 | Nelson et al. . | |
| 3,934,104 | 1/1976 | Stout | 200/314 |
| 4,249,057 | 2/1981 | Schlegel et al. | 200/296 |
| 4,365,120 | 12/1982 | Pounds | 200/5 A |
| 4,367,384 | 1/1983 | Waarle | 200/159 B |
| 4,370,533 | 1/1983 | Kamei et al. | 200/159 B |

FOREIGN PATENT DOCUMENTS

| | | | |
|---|---|---|---|
| 3041470 | 6/1982 | Fed. Rep. of Germany | 200/159 B |
| 2039417 | 8/1980 | United Kingdom | 200/159 B |

*Primary Examiner*—John W. Shepperd
*Attorney, Agent, or Firm*—Spencer & Frank

[57] ABSTRACT

Switching device for installation in a switchboard or the like, composed of: an actuator composed of a housing and a plunger and arranged to be pushed into and fastened to a supporting wall; and a contactor joined and fastened to the actuator and arranged to be on the interior of the supporting wall, wherein the contactor includes a supporting member connected to a plate arranged to be parallel to the supporting wall and carrying conductor paths and a rubber elastic membrane body coaxial with the plunger and carrying a layer of a conductive elastomer, the membrane body being located to be disposed between the plunger and the plate with the layer of conductive elastomer facing the plate, and with the plunger being actuatable to press against the membrane body and deform the latter in the axial direction in order to press the layer of conductive elastomer against the conductor paths.

12 Claims, 7 Drawing Figures

1
2
22
3
5
11
II
II
4
13
10
6
8
9
14
12
7
23
15
24
18
17
21
20
16

6
9
1
I
8
2
24
4
21
20
7
11
16
I

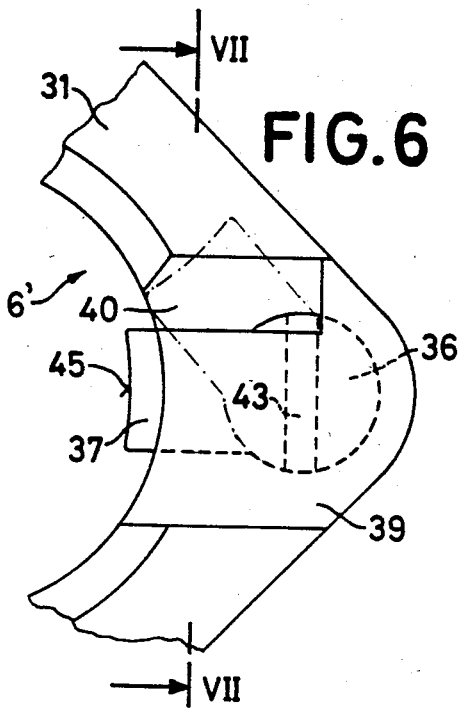
FIG. 6
FIG. 7
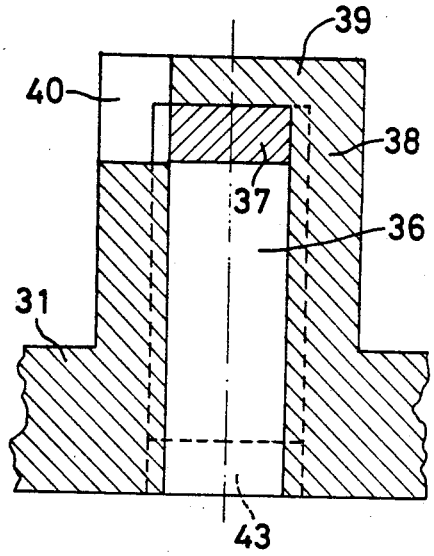

PANEL MOUNTED SWITCHING DEVICE

BACKGROUND OF THE INVENTION

The present invention relates to a switching device, or instruction key, for installation in a switchboard or the like, comprising two parts, namely an actuator including a housing and a plunger and designed to be plugged into and fastened to a supporting wall, and a contactor to be joined with and fastened to the actuator on the interior of the supporting wall.

Instruction keys of this type are known to have contactors including metal contact tongues or, less frequently, to be designed as inductive or capacitive proximity switches.

The advance of electronic circuits even for controlling devices which conduct high currents makes it appear desirable to fasten printed circuits, i.e. plates provided with conductor paths, directly to the contactor or, conversely, to fasten the entire instruction key on a plate to thus simplify the circuitry and create components having smaller volumes. However, in this procedure as well, the connecting leads for the contactor must be individually soldered to the conductor paths on the plates.

On the other hand, it is known, for example, for pocket computers, to electrically connect conductor paths with the aid of rubber elastic pressure members provided with a conductive, elastomer coating. Generally, a plurality of such actuating membranes are combined into a pad which forms the keyboard field of an operator's keyboard.

SUMMARY OF THE INVENTION

It is an object of the present invention to provide a simpler contactor by the known use of the conductor paths themselves as the contact surfaces, with such contactor being usable in conjunction with conventional actuators and permitting an inactive length of stroke of the plunger required for safety reasons as well an overstroke which is unavoidable for proper operation of lock actuators, flip switch and toggle switch actuators.

Based on an instruction key of the above identified type, this is accomplished by the present invention in that the contactor includes a supporting member which can be connected with a plate carrying the conductor paths and extending parallel to the supporting wall, wherein the supporting member includes a rubber elastic membrane body disposed between the plunger and the plate and coaxial therewith. When the plunger is actuated, it places itself against the membrane body, deforms it in the axial direction and thus presses a layer of a conductive elastomer, which is attached to the membrane body, against the conductor paths. The decisive advantage is thus that, for installation, such a contactor is simply screwed to a plate provided with suitably designed conductor paths. In this case, either the instruction key is mounted, as customary, to a supporting wall and supports the plate or, conversely, the contactor with associated actuator is fastened to a supporting plate.

In particular, the membrane body may be designed as a ring membrane so that it is possible to employ illuminated actuators, with the ring membrane enclosing the socket of a display lamp and/or its electrical connecting lines. These connecting lines are connected with corresponding conductor paths on the plate.

The membrane body may be designed in such a manner and arranged in the supporting member in such a way that the plunger must traverse an inactive distance of 3 mm before it contacts the membrane body, so that, according to present safety regulations, inadvertent actuation is avoided. On the other hand, a correspondingly designed membrane body also permits a considerable amount of overstroke once the conductive elastomer layer contacts the conductor paths, so that, for example, the locking bolt of a slide lock can engage safely, or other special switch drives, whose length of movement has greater tolerances, can operate properly. With respect to the above-mentioned overstoke, the present invention offers a particularly suitable embodiment in which the membrane body has a possibly radially perforated collar which can be compressed over a long path.

The conductive layer providing the contact on the membrane body may be divided into a plurality of individual segments, each having two associated conductor paths. In the simplest case, the conductor paths to be connected are concentric arc segments; but they may also be meshed or boxed together in the form of a comb or meander.

The above-described instruction keys are frequently arranged in large numbers in close proximity on a switchboard, with the individual contactors all being screwed to a common plate (printed circuit). This leads to difficulties in fastening the contactors to their respective actuators. This can be explained as follows.

Various types of fastening are known, the simplest employing fastening screws. More popular are snap connections, according to which the contactors are pushed into an associated actuator on the interior of the supporting wall, causing resilient detent members to perform a deflecting movement. In the end position, when the contactor has been inserted completely, these detent members snap in and secure the contactor against being pulled out of the actuator. To release the connection, the detent members must be pried out by means of a screwdriver, or a special tool must be employed. Finally, commonly owned U.S. Pat. No. 4,249,057 discloses unlocking of the detent tongues which have dropped into surface recesses in an actuator housing by slightly rotating the contactor with respect to the actuator, for example by 20°, whereupon the contactor can be pulled out.

If, however, in the sense of the present invention, the contact makers are connected with a larger plate and are covered thereby, access to the screws, detent tongues, latches or similar fastening members is impossible. Releasing the detent tongues by rotating the contactor is also impossible in this case, since the supporting members are firmly connected together by means of the plate and cannot be rotated individually. Thus to be able to replace, for example, a contactor or actuator, it is initially necessary to laboriously remove the plate, i.e. all fastening screws holding the individual supporting members to the plate must be loosened. If the connection between supporting members and plates is made by means of glue or another permanent means, disassembly without destruction would be completely impossible.

To overcome the above-described difficulty and to be able to simply and quickly remove the plate together with all supporting members fastened thereto from the actuators for the purpose of maintenance or the replacement of instruction keys, it is proposed to make the fastening members which are effective between contactor and actuator accessible through openings in the plate for the purpose of establishing and/or releasing the connection.

This is for the purpose of constructing the fastening members in such a manner that they can be actuated by means of a tool pushed through the board, at least in the sense of releasing the lock. This is applicable, for example, for the use of fastening screws which are arranged parallel to the center axis of the instruction key, in which case a hole which has approximately the same diameter as the head of the screw is provided in the plate in line with the screw axis.

A particularly suitable manner of fastening is effected with a rotatable bolt mounted in the supporting member and actuatable through an opening in the plate so as to be pivoted into a radial recess in the actuator housing. The rotatable bolt here forms the fastening member which prevents removal of the supporting member from the actuator. Advantageously, actuators as disclosed in the above-cited U.S. Pat. No. 4,249,057 can be used without modification, since they are provided with suitable recesses at the exterior faces of a tubular extension of the actuator housing.

If there are larger groups of instruction keys (key fields), it is not absolutely necessary that each individual contactor or its supporting member be latched to the respectively associated actuator. Rather, it is sufficient to provide only a few openings in the plate to be able to bolt and unlatch a corresponding number of supporting members which are appropriately distributed over the field of keys. This facilitates removal of the plate and simplifies design and manufacture of compactly designed circuit boards equipped with densely arranged conductor paths.

Embodiments of the invention will now be described with reference to the drawing.

BRIEF DESCRIPTION OF THE DRAWING

FIG. 6 is a top view of the portion of the supporting member of FIG. 7 including the rotatable latch.

FIG. 7 is a sectional view along line VII—VII of FIG. 6.

DESCRIPTION OF THE PREFERRED EMBODIMENTS

Figure 1:
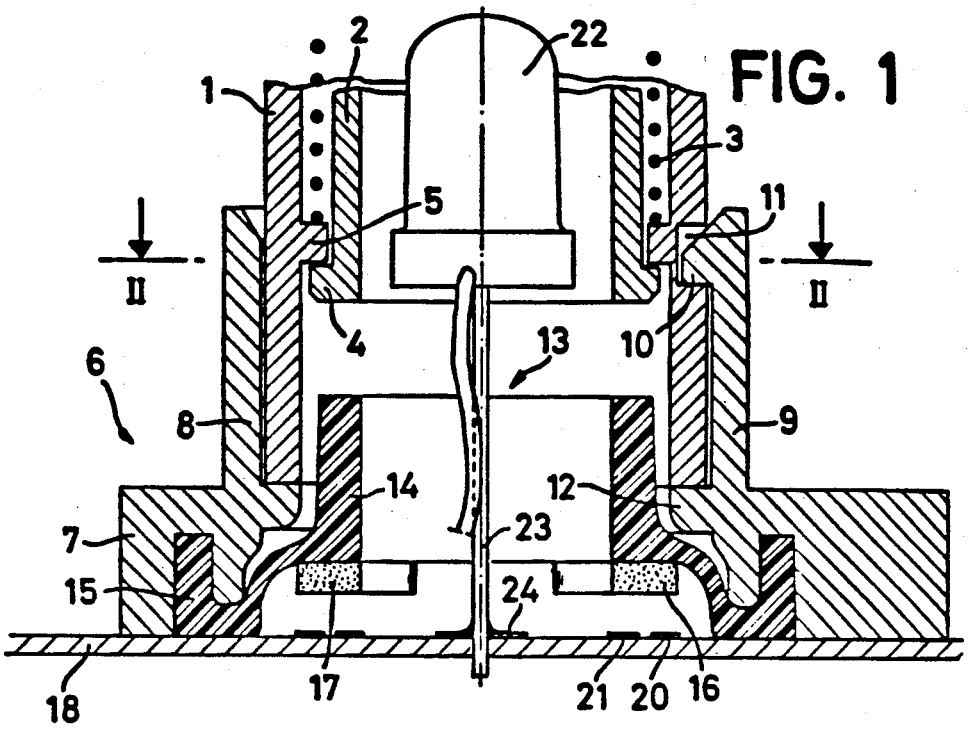
FIG. 1 is an axial sectional view along line I—I of FIG. 2 of the lower portion of an instruction key according to the invention.
Figure 2:
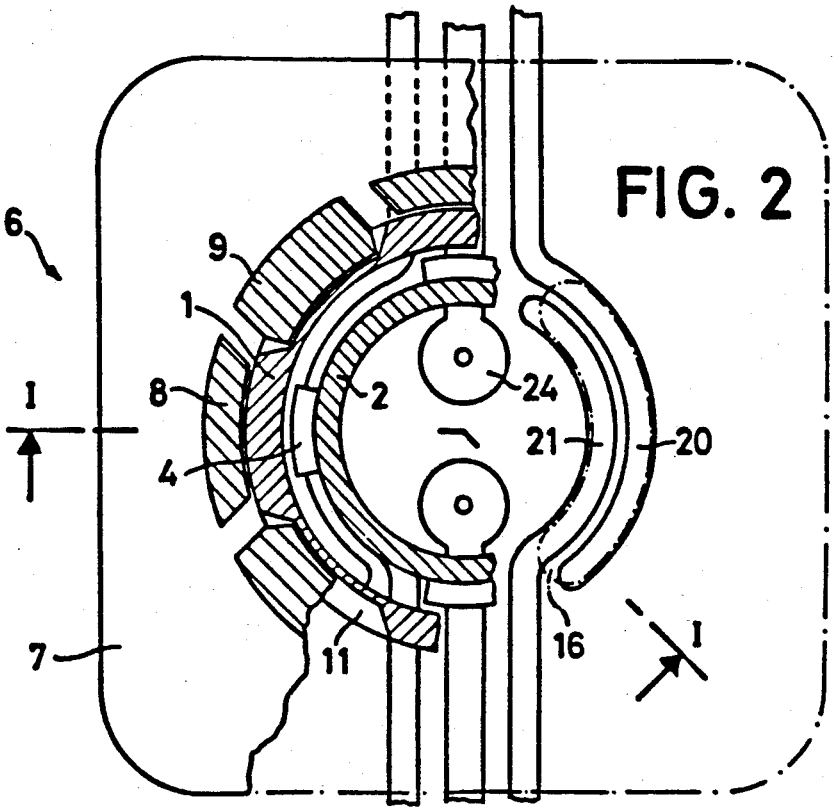
FIG. 2 is a cross-sectional view along line II—II of FIG. 1, with parts broken away.
Figure 3:
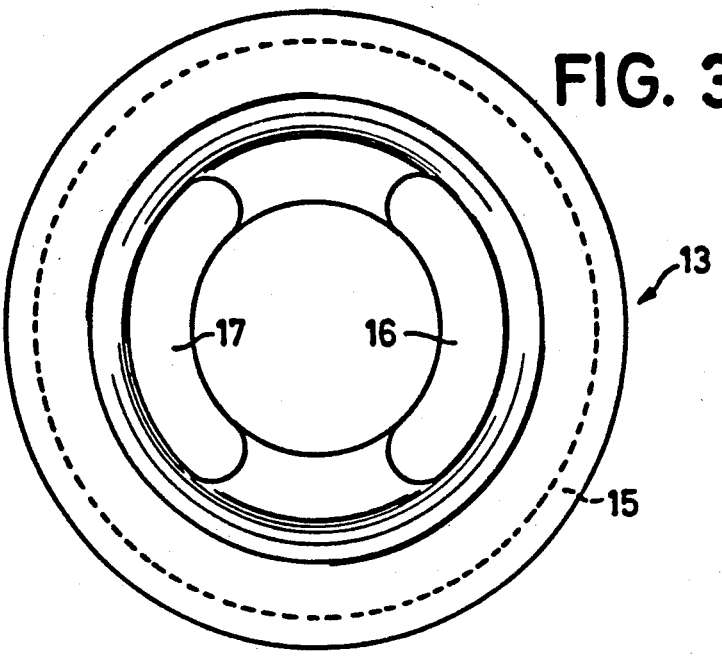
FIG. 3 is a bottom view of the membrane body of the key of FIGS. 1 and 2.

FIGS. 1 and 2 show the sleeve-shaped end piece of the housing 1 of an actuator as well as the end of its likewise sleeve-shaped plunger 2. The plunger 2 is held in its rest position by a compression spring 3 while being supported by radial projections 4 at abutments 5 of the housing which also serve as lower abutments for compression spring 3.

Housing 1 of the actuator is plugged into and latched to a supporting member 6 comprising a square base member 7 and an essentially cylindrical receptacle portion, the latter being divided by longitudinal slits into eight strip-shaped segments constituted by four segments 8 alternating with four segments 9. At the top of each segment 9 there is a lip 10 which is snapped into a corresponding recess 11 in housing 1. The frontal face of housing 1 rests against an inner collar 12 of base member 7. Housing 1 and plunger 2 can be removed from member 6 simply by rotating housing 1 from the position shown in FIG. 2 until the housing parts between recesses 11 press segments 9 outwardly.

A membrane body 13 of rubber or another elastomer is inserted into base member 7 and is divided into a hollow cylindrical collar 14, a thin, curved membrane zone and a flange with plug-in collar 15, the latter being plugged into a matching annular groove at the underside of base member 7. The membrane body is provided with two kidney-shaped contact pieces 16 and 17 made of a conductive silicone rubber. Base member 7 is placed onto a plate 18 and fixed thereto so that membrane body 13 is locked into supporting member 6.

In the region of the illustrated instruction key, the upper side of plate 18 is provided with two pairs of conductor paths, each pair forming two concentrically arranged arc sections, e.g. 20 and 21. These arc sections cooperate with the contact piece 16 disposed thereabove, while the other two arc sections cooperate with contact piece 17.

Figure 4:
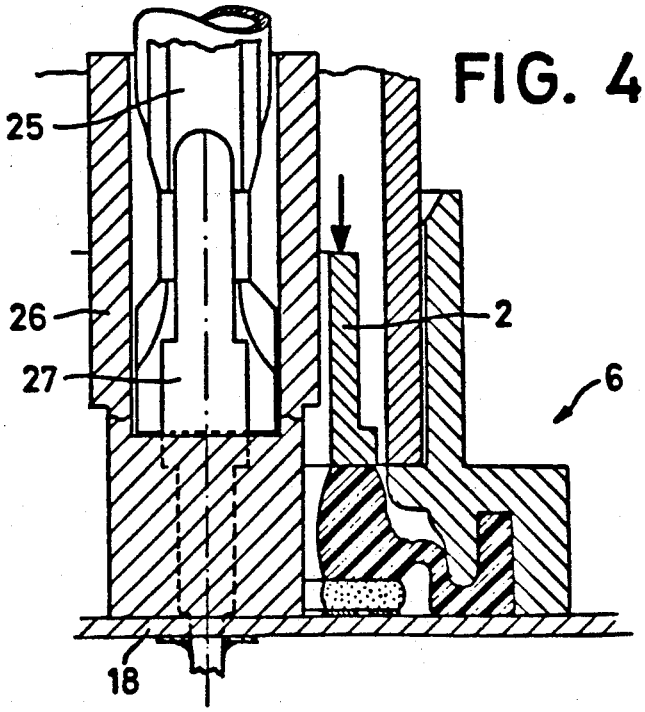
FIG. 4 is a partial sectional view similar to FIG. 1 with a different lamp and the membrane body in the contact making position.

Thus, the arrangement forms a two-pole on-switch. If plunger 2 is pushed downwardly by pressure on its key face (not shown), it performs an idle stroke of 3 mm, before coming into contact with collar 14 of membrane body 13. During the further course of the movement, the membrane body is deformed and contact pieces 16 and 17 come into contact with corresponding arc sections 20 and 21 of the conductor paths to thus electrically connect them. If finally the plunger is depressed even further or, for constructive reasons, an overstroke occurs in certain actuators, collar 14, in particular, is compressed further, as shown in FIG. 4. Once plunger 2 is released, it and membrane body 13 move back into their starting positions shown in FIG. 1.

Due to the ring shape of membrane body 14, it is possible to illuminate the touch surface of the actuator from the interior, as is customary. In the embodiment of FIG. 1, a light emitting diode (LED) 22 is provided which, with the aid of its two connecting wires 23, is held in the interior of plunger 2. The connecting wires 23 are inserted into plate 18 and are soldered to special conductor paths 24 which serve as current leads.

Likewise, another light source may be provided which penetrates membrane body 13. The embodiment of FIG. 4 shows a socket for a so-called telephone plug-in lamp 25 whose guide sleeve 26 includes two contact strips 27. These strips are pushed through plate 18 and are soldered to current supplying conductor paths at the underside of plate 18.

Figure 5:
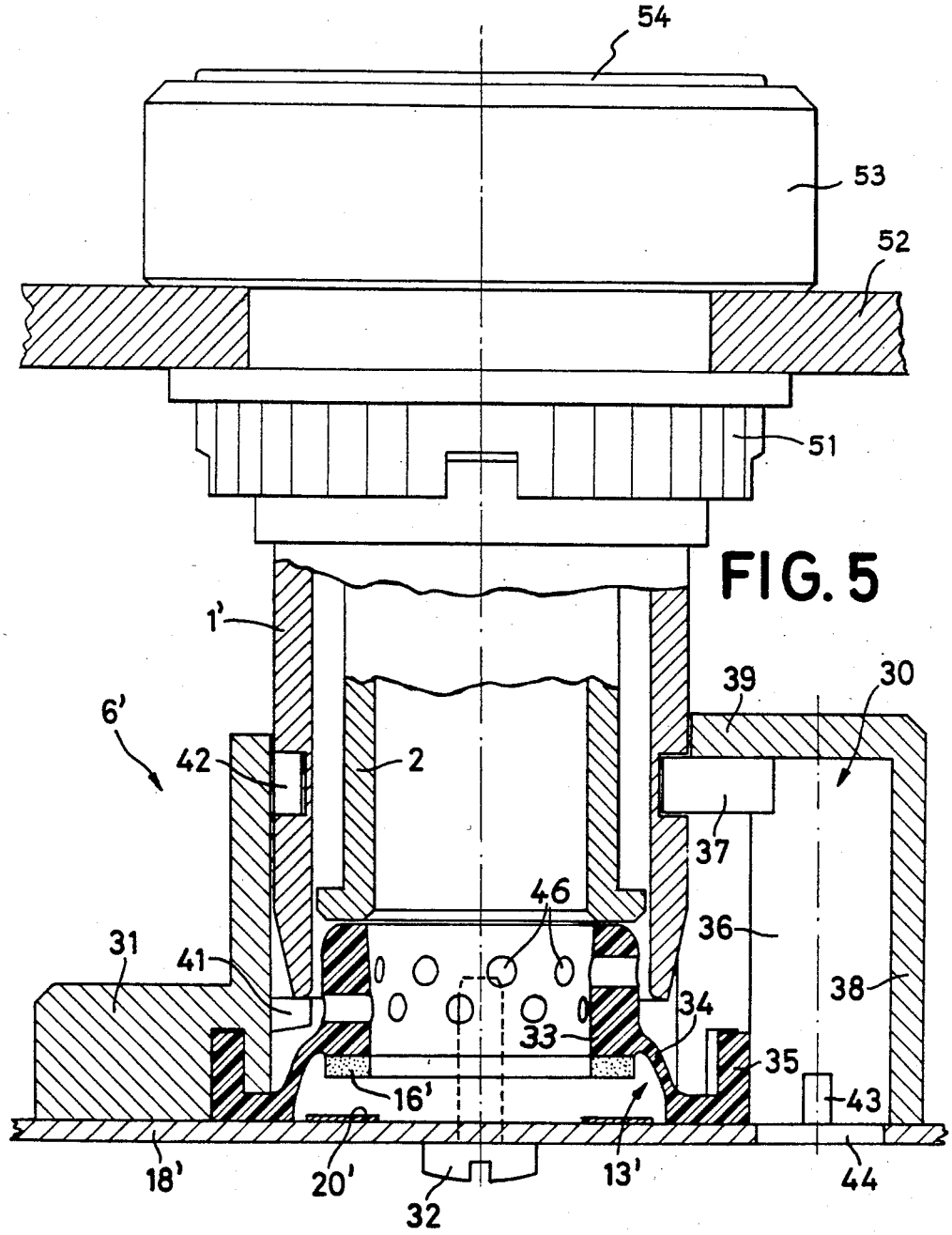
FIG. 5 is an axial sectional view of another instruction key employing a rotatable bolt.

FIG. 5 shows an actuator housing 1', having a tubular plug-in member, and its plunger 2. Housing 1' is attached by means of a screw ring 51 to a supporting wall 52. At the front of supporting wall 52 there is a housing part 53 containing a pushbutton 54 which is part of plunger 2. A supporting member 6' receives the housing 1' in its cylindrical interior of corresponding diameter and secures it against retraction by means of a rotatable bolt 30. At its two corners lying outside of the plane of FIG. 5, the plate-shaped, essentially square base 31 of the supporting member is screwed to a conductor plate 18 by means of two screws 32.

A membrane body 13' made of an elastomer is inserted into base 31. This membrane body 13' is divided into a hollow cylindrical collar 33, a thin, curved membrane zone 34 and a flange having a plug-in collar 35, the latter being received in a matching annular groove at the underside of base 31. Membrane body 13' is provided with a contact ring 16' of conductive silicone rubber. In the region of this contact ring 16', conductor plate 18' is provided with conductor paths 20' in the form of two concentric rings meshing with one another by means of external and internal teeth, respectively. If plunger 2 is pressed downwardly, it deforms the membrane body until contact ring 16' rests on the indicated conductor paths 20' and conductively connects them together. The lamp to provide illumination of the interior of the head of the plunger is not shown here.

To accommodate the rotatable bolt 30 comprised of a cylindrical pin 36 and a radial bolt finger 37, a bearing housing including a wall 38 and ceiling 39 is disposed in one corner of base 31. A cylindrical interior of the bearing housing corresponding to the diameter of the pin is connected by means of a longitudinal slit with the larger cylindrical interior accommodating housing 1' of the actuator. The width of the slit corresponds to the width of the bolt finger 37 so that, during installation, the rotatable bolt 30 can be inserted from below into the bearing housing.

At its top side, the bearing housing has an opening 40 which permits rotation of rotatable bolt 30 to the right by about 45° as shown by the dot-dash line in FIG. 6. In this position, bolt 30 is pivoted out of the inner cross section of the large cylindrical opening in supporting member 6' so that housing 1' can be inserted into supporting member 6'. Abutments 41 shaped on its interior determine the end position in which one of four recesses 42 on the outer face of housing 1' is at the same height as catch finger 37. With the aid of a screwdriver fitting into a slit 43 at the lower frontal end of pin 36 and pushed from below through an opening 44 in plate 18', rotatable bolt 30 can now be rotated to the left by 45° so that catch finger 37 pivots into the respective recess 42.

The concave shape of frontal face 45 of the bolt finger, which face is adapted to the interor shape of recess 42, has a certain detent effect so that rotatable bolt 30 noticeably snaps in and will not inadvertently come out of the latched position as a result of shocks.

In order to hold the rotatable bolt securely in supporting member 6' before the instruction key is installed, wall 38 may be thickened locally so that the rotatable bolt is held by a clamp effect.

It will be understood that the above description of the present invention is susceptible to various modifications, changes and adaptations, and the same are intended to be comprehended within the meaning and range of equivalents of the appended claims.

What is claimed is:

1. Switching device for installation in a switchboard or the like, comprising: an actuator composed of a housing arranged to extend through an opening in a supporting wall and to be secured in the supporting wall, said actuator further including a plunger mounted in said housing to be movable relative to said housing in a given direction between a rest position and a depressed position, and biassing means associated with said plunger for urging said plunger toward its rest position; a contactor mounted to be stationary relative to said actuator housing and arranged to be on the interior of the supporting wall, said contactor including a supporting member, means associated with said supporting member for supporting a plate arranged to be parallel to the supporting wall and carrying conductor paths, a rubber elastic ring membrane coaxial with said plunger and carrying a layer of a conductive elastomer facing the location of the conductor paths, said membrane being deformable for moving said conductive elastomer in the given direction against the conductor paths, and a cylindrical collar connected to said membrane and extending from said membrane toward said plunger, with the axis of said membrane being parallel to the given direction of movement of said plunger, said collar being axially compressible, said membrane being constructed to have a resistance to deformation, in said given direction, which is less than the resistance of said collar to axial compression, and said ring membrane and said collar being disposed between said plunger and the location of the conductor paths, and being arranged such that when said plunger is moved toward its depressed position, said plunger initially moves into contact with said collar, then displaces said collar and said membrane for causing said layer of conductive elastomer to contact the conductor paths before said plunger reaches its depressed position, and finally axially compresses said collar, whereby movement of said plunger into its rest position is effected by said biassing means.

2. Switching device as defined in claim 1 wherein said ring membrane encloses the socket of a display lamp.

3. Switching device as defined in claim 1 wherein said ring membrane encloses the connecting leads of a display lamp.

4. Switching device as defined in claim 1 wherein said layer of conductive elastomer is divided into a plurality of individual segments, each associated with two conductor paths.

5. Switching device as defined in claim 1 wherein said collar is radially perforated.

6. Switching device for installation in a switchboard or the like, comprising: an actuator composed of a housing having an axis and arranged to extend through an opening in a supporting wall so that the axis of said housing is substantially perpendicular to the supporting wall and to be secured in the supporting wall, said actuator further including a plunger mounted in said housing to be movable relative to said housing, and said housing having a recess in its outer surface; a contactor supported by said housing and arranged to be on the interior of the supporting wall, said contactor including a supporting member, means associated with said supporting member for supporting a plate which is arranged to be parallel to the supporting wall, is provided with an opening, and carries conductor paths, and a rubber elastic membrane body coaxial with said plunger and carrying a layer of a conductive elastomer, said membrane body being located to be disposed between said plunger and the plate with said layer of conductive elastomer facing the plate, and with said plunger being actuatable to press against said membrane body and deform the latter in the axial direction in order to press said layer of conductive elastomer against the conductor paths, said contactor further including a rotatable bolt mounted in said supporting member for pivotal movement about an axis substantially parallel to the axis of said housing and having a projecting part engageable in said recess in said housing for detachably securing said contactor to said housing, said bolt further having means accessible through the opening in the plate via which said bolt is pivotable about its axis between a position in which said projecting part engages in said recess and a position in which said projecting part is clear of said recess for permitting said contactor, with the plate, to be removed from said housing.

7. Switching device as defined in claim 6 wherein said membrane body is in the form of a ring membrane.

8. Switching device as defined in claim 7 wherein said ring membrane encloses the socket of a display lamp.

9. Switching device as defined in claim 7 wherein said ring membrane encloses the connecting leads of a display lamp.

10. Switching device as defined in claim 6 wherein said membrane body is provided with a collar which is compressible over a long path.

11. Switching device as defined in claim 10 wherein said collar is radially perforated.

12. Switching device as defined in claim 6 wherein said layer of conductive elastomer is divided into a plurality of individual segments, each associated with two conductor paths.

* * * * *